United States Patent [19]

Rawles et al.

[11] 4,217,462

[45] Aug. 12, 1980

[54] ROTARY FURNACE FOR THE FUSION OF MINERAL BEARING SUBSTANCES, APPARATUS AND METHOD

[76] Inventors: William T. Rawles, 207 Haynes Blvd., Greeneville, Tenn. 37743; Kenneth Jenkins, Box 50 A, Moshein, Tenn. 37818

[21] Appl. No.: 27,155

[22] Filed: Apr. 4, 1979

Related U.S. Application Data

[63] Continuation-in-part of Ser. No. 904,441, May 9, 1978, abandoned.

[51] Int. Cl.[2] ..... F27B 7/10; F27B 7/32; F27B 7/34

[52] U.S. Cl. ..... 13/10; 13/33; 266/213

[58] Field of Search ..... 13/9, 10, 33; 266/213, 266/204

[56] References Cited

U.S. PATENT DOCUMENTS

| | | | |
|---|---|---|---|
| 2,121,109 | 6/1938 | Weinheimer | 13/10 X |
| 2,997,006 | 8/1961 | Grosse | 13/10 UX |
| 3,102,154 | 8/1963 | Renton | 13/10 |
| 3,795,752 | 3/1974 | Verhoeven et al. | 13/10 X |
| 3,821,455 | 6/1974 | Greenewald, Jr. | 13/9 R |
| 3,937,866 | 2/1976 | Sunnen et al. | 13/9 R |

*Primary Examiner*—Roy N. Envall, Jr.
*Attorney, Agent, or Firm*—J. Gibson Semmes

[57] ABSTRACT

Furnace apparatus and method, for the continuous electric heating or fusion of particulate mineral-bearing substances, wherein a cylindrical furnace housing is adapted to trunnion bearing, the housing having at least one detachable and elongated conical extension at ends for dumping, the extensions likewise having electrode openings which are coaxially aligned with the housing, whereby a charge of the mineral-bearing substance may be introduced either during fusion or heating or roasting or firing, thus permitting partial filling of the furnace housing and sequential build-up, protecting the respective ends of the furnace against dead space and excessive charge recycle. By virtue of design, the conical ends are shielded against burning out by unbearable heat generated from the electrode arc. Inherent advantages occur by highly accelerated rotation, yielding resultant centrifugal forces which are applied to the charge.

5 Claims, 4 Drawing Figures

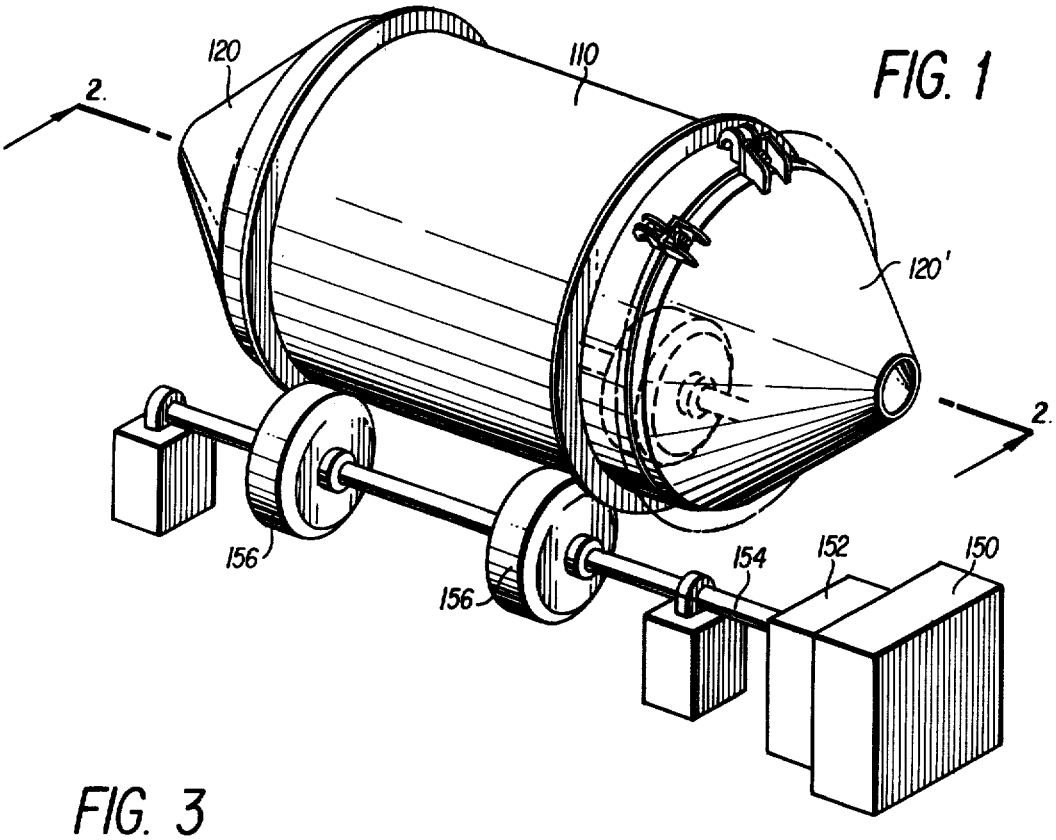
FIG. 1
FIG. 3
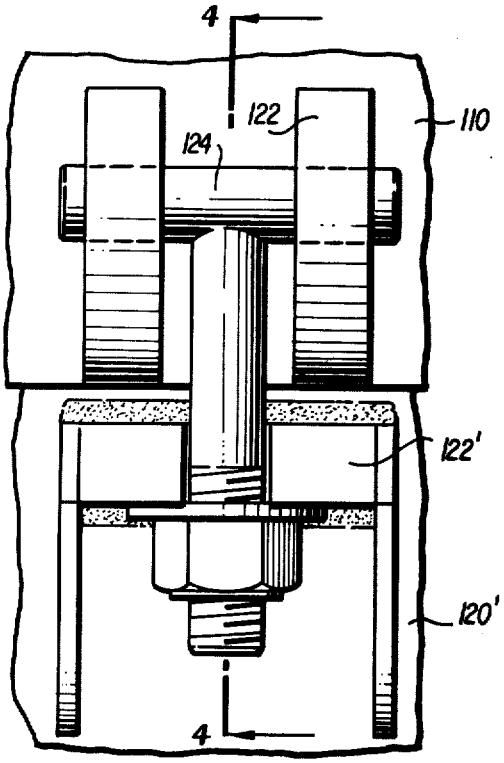
FIG. 4
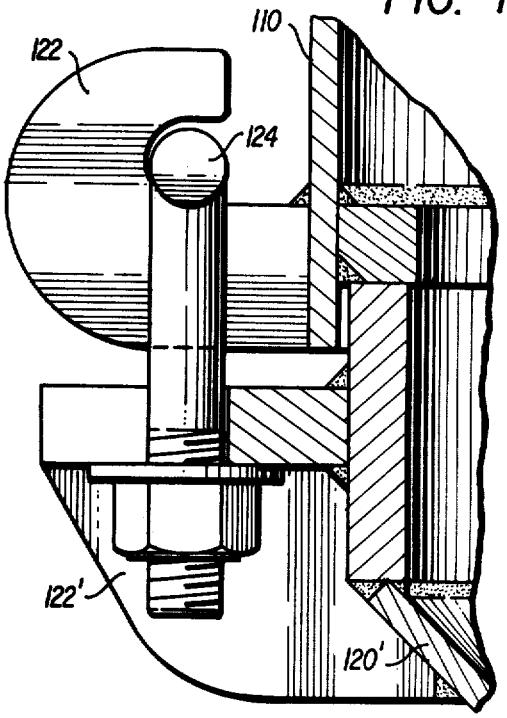

ROTARY FURNACE FOR THE FUSION OF MINERAL BEARING SUBSTANCES, APPARATUS AND METHOD

CROSS-REFERENCE TO RELATED APPLICATIONS

This is a Continuation-In-Part of patent application Ser. No. 904,441, filed May 9, 1978, now abandoned, entitled ROTARY FURNACE FOR THE FUSION OF MINERAL BEARING SUBSTANCES, METHOD AND APPARATUS.

BRIEF DESCRIPTION OF THE PRIOR ART

Prior art in the fusion of such materials as silicon dioxide in granular form, magnesium oxide, silicon carbide and the like are variously represented by the following U.S. Pat. Nos.:

2,039,858 Stenhouse;
2,147,070 Weinheimer;
2,688,046 Norton;
3,286,012 Foex;
3,795,752 Verhoeven;
3,821,455 Greenewald;
3,973,866 Sunnen.

With respect to the art, the present invention being adapted primarily in fusion process to high rotary speeds, does not hold nor attempt to hold the material under treatment in a refractory as in Stenhouse aforesaid; rather the unmelted substance of the within invention contains its own melt, thereby avoiding contamination. The concept of Weinheimer is known as the "Detroit Rocking Furnace," whereby the substance under treatment is mixed or disposed on the bottom of the furnace for more efficient heating, a concept which is highly distinct from high speed method herein, applying a centrifugal force to the substance under treatment. The Norton, et al concept suggests a preheating of the charge by conventional means but does not suggest the method and apparatus of applicant's invention. The Foex development comprises plasma technology, having unique problems and construction maintenance, the only comparison being in the reliance upon centrifugal forces sustaining the charge out of the gas or arc path. Noteworthy also is the absence in applicant's device of reinforced and very heavy construction. With respect to Verhoeven and Sunnen et al, the patents are related to artificially cooled techinques of arc and plasma control, as opposed to the unique mode and apparatus by which applicant operated an efficient, self-cooling rotating kiln which serves as a centrifuge, having axial heating electrodes, wherein there is a simultaneous forming of arc and feeding to avoid maintenance problems which normally develop in methods and apparatus of this type.

The Greenewald reference describes an indirect arc metal melting furnace having a heat insulated double shell assembly, the interior of which contains a cruciable lining. An ionizable gaseous atmosphere is maintained within the sealed cruciable interior during operation. Greenewald makes it clear that the disclosed double shell construction, the insulation therebetween, and the porous cruciable lining are essential to achieving the stated objective of minimizing moisture outgassing. In order for the furnace to operate in the desired manner, it is necessary, as well, to maintain the ionizable gaseous atmosphere within the cruciable interior. It is thus necessary that the inner shell be substantially gas tight and that the electrode means be in sealed relationship to the inner and outer shells. It is, therefore, quite apparent that the disclosed construction is critical to the operation of the Greenewald furnace.

As to the process claimed in Sunnen, et al, the arcing electrodes of Greenewald could not be employed to draw a plasma beam, assuming a combination of these references. Sunnen, et al make it clear that the illustrated construction and configuration of the furnace is not essential to the practice of their process.

Unlike any of these references, taken alone or in combination, the present invention provides for a novel, removable conical end to the furnace. This construction not only permits facile removal of the finished ingot, but also permits in fusion, the utilization of the centrifugally displaced charge itself to insulate the ends of the device from exposure to excess heat. Thus, in contradistinction to Greenewald, no refractory lining is needed for operating the instant furnace in the fusion mode. In further conjunction with the present uniquely constructed conical ends, means are provided for readily removing reaction gasses which develop at high temperatures. Neither Greenewald nor Sunnen, et al disclose nor suggest means for removal of these gasses.

BEIEF DESCRIPTION OF THE DRAWINGS

Referring to the drawings:

FIG. 1 is a view in perspective of a perferred form of apparatus adapted to the invention.

FIG. 3 is a plan view of a clamp assembly, securing removeable cone to cylindrical kiln housing.

FIG. 4 is a view in vertical section of the clamp of FIG. 3.

DETAILED DESCRIPTION OF INVENTION

Figure 2:
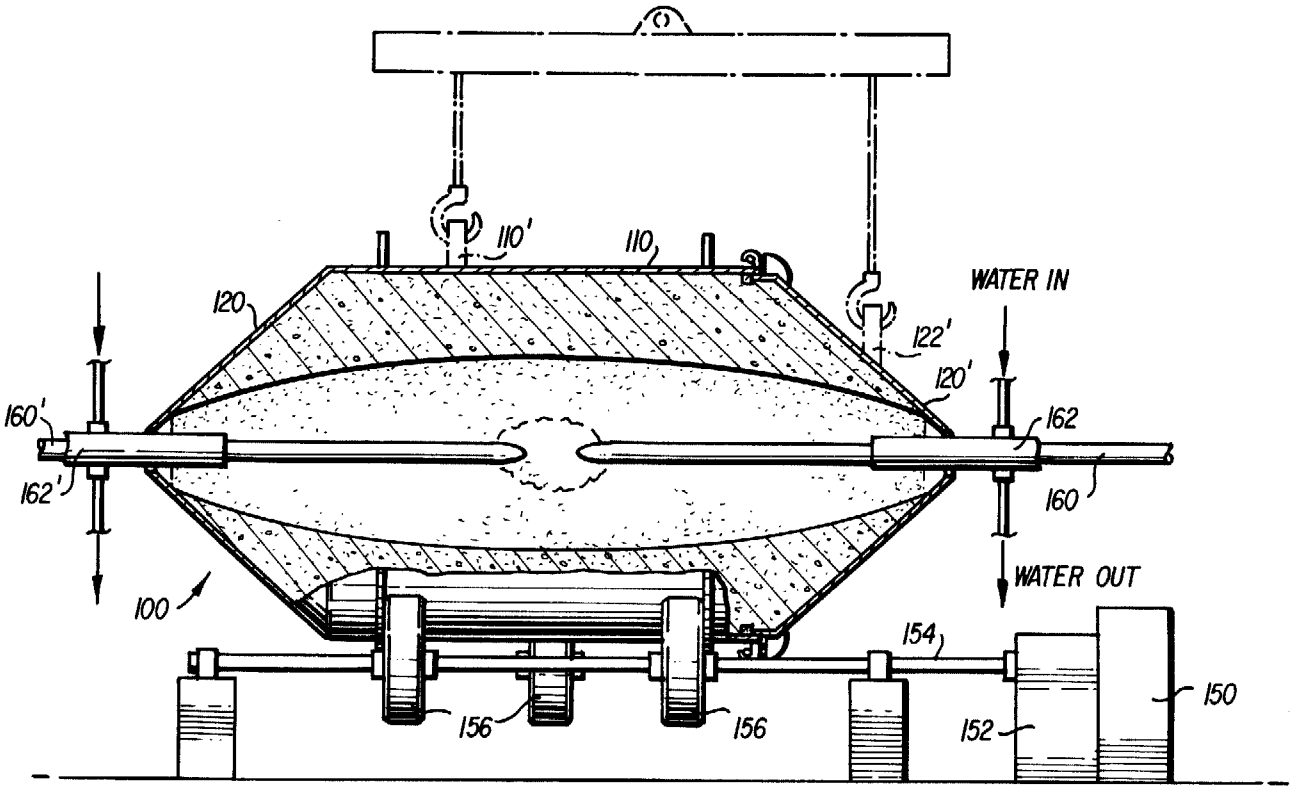
FIG. 2 is a view in vertical section of invention, taken along the lines 2—2 of FIG. 1.

Referring to FIGS. 1 and 2, the rotary kiln or furnace 100 comprises a cylindrical housing 110 which is of thin wall generally cylindrical design. The housing has cones 120 and 120' secured at ends thereto, the detachable cone 120' being secured by means of suitable external clamping means 122–122', securing same by means of tee bolt 124 to kiln cylinder 110. The cones, it will be noted are substantially elongated, relative to the cylinder—for reasons which will appear hereinafter. Actually, in fushion they are progressively charged with the materials to be fused. The angle of the walls of the cone, relative to furnace axis must be less than 45°, preferably in the range of 30°–40°. In heat treatment also one desires to give a flat angle to the cones so as to protect the ends of the furnace and its charge from absorbing too much heat. In preferred form the drive system 150 comprises an external motor which engages the drive shaft 154, a suitable gear reduction transmission 152 being interposed between motor and shaft. Driving wheels 156 being keyed to the journalled shaft which supports the kiln by engagement to impart rotation thereto.

Appropriate electrodes 160–160' are introduced for reciprocal horizontal adjustment, internally of the furnace so as to provide the necessary high voltage arc for heating and/or fusing the substances under treatment which may be gravity fed bia portable hoppers, not shown. The electrodes 160–160' may have water cooling jackets 162–162' at the zone of oxidation which is adjacent the respective outer cone end apertures. In fusing practice, the charge or particulate substances may be incrementally introduced into the interior of the furnace, sufficiently so that portions of the charge first-in are fused, heated and/or fired from the outer, interior of the kiln to the inner, interior thereof. This high speed mode is significant because it permits utilization of the device without the addition of expensive refractory linings. Otherwise and in heat treatment, per se, refractory linings are required, reference parent application Ser. No. 904,441, aforesaid.

The specific conical end characteristic of the furnace is such as to insure maintenance of the ends 120–120' against deterioration. Ideally the angle of inclined walls of the cones is set at 30°–40° from the center axis of the furnace. Where the fusion heat at the central arc exceeds 2950° F., for example, the heat at the tip of the cone may and has been proven to be approximately no more than half of the heat at the central arc. In fusing, as opposed to heating, this feature of the invention permits the charge, which has been centrifugally forced to the exterior, to serve as an insulation to the ends of the device as will be apparent from reference to the drawings. In charging initially for fusion, the mid or cylindrical section of the furnace is charged first—the charge being introduced while the furnace is rotating slowly, viz: 50 rpm; whereupon the speed of rotation is increased to 120–130 rpm, removing the "tumble" of the initial charge and setting it against the cylindrical walls. At this time the throat of the cylinder formed by the conical ends is charged gradually from critical speed to catch up speed by injection methods whereby to coat inside all of the metal of the furnace. Thus, the initial charge forms a surface which is essentially parallel to a centerline axis of the furnace, stopping at ends near the junction of cylinder and conical ends but overlapping the latter, FIG. 2. The sequential or secondary charging effects a conical packing from the inner extremity of the cones to the outer extremity, leaving an axial hole for the electrodes.

Upon completion of the fusion process, the entire kiln is crane lifted from the driving cradle support 156 and the cone 120' removed, whereupon the kiln is tilted and the formed ingot dumped, together with the unfused residual of the charge. This residual is recycled or otherwise used to preheat another charge by heat exchange.

Other advantages of the invention include the avoidance of endwise journals which operators must traverse in loading and/or unloading. Here, in contrast to the art is permitted partial filling as in fusion and is included the possibility of utilizing higher power arcs without fear of burning the materials under treatment. The overall charge, as indicated, may be "built up," protecting thereby the metal ends from "seeing the heat" and thus permitting use of thinner skin metal to form the furnace itself. Additionally, the fact that ends of the furnace are not utilized in supporting the kiln or furnace, simplifies maintenance. Here, the furnace is so constructed that the removeable cones tend by a "wedging fit" to reinforce against distortion the ends of the cylindrical shell forming the kiln housing.

Again, and as in the case of preparing the device for fusion of particulate substances such as silicon, the furnace may be completely lined with a castable by introducing the castable while spinning fast, the castable being thrown by centrifugal force to its sides, and sequentially readily cured by heat while spinning.

Upon use of the rotary kiln for roasting or heating, as opposed to fusion aforesaid, the kiln may be rotated slowly at less than critical speed, i.e.: at speeds which are generally not in excess of twenty to twenty-five rpm, causing the charge to tumble inside. In this practice, a refractory lining must be applied to the cones to permit a "keying in" of the refractory bricks; in this way avoiding the horizontal thrust problem which occurs in the conventional upright ended wall kilns. The cones thus run much cooler at ends of the kiln, than is the case in prior art devices having upright ends; ends which may be at right angle to the center axis of rotation. Rather than absorbing incident radiant heat, the disposition of the charge reflects heat adjacent the cones, by virtue of the prescribed angle thereof, relative to the center axis of the furnace. Thus for heating at low rotary speed, the same advantages are achieved as in the high fusion process.

One further advantage is known to reside in the permissable development herein of reaction gases at the high temperatures as for instance through the combination of silicon dioxide and carbon, resulting in silicon carbide and carbon monoxide. By design, these are more readily removed from the conical ends of the furnace, than could possibly be achieved in prior art devices.

Among the problems in fusion and roasting, a deterioration of the electrodes occurs, by virtue of oxidation in the throat zones at ends of the furnace. This oxidation is caused by the intermittant charge of say a 60 cycle arc, an on-off functioning of the electrodes, whereby the arc plasma expands and retracts in volume, pulling air in on retraction or collapse etc. In FIG. 3 the electrode is encased at the end zone in a piping which piping is supported by carriage, the piping covering the zone of earlier oxidation to preclude it herein, the net effect being to also preclude fusion laterally in this pipe zone, so to speak—the pipe occluding the heat of fusion. By design the pipe may be jacketed for water cooling, but in either configuration, an annular orifice must exist between pipe and/or jacket and the cone outlets.

In fusion practice, the removal of one end cone permits tilting the furnace to dump the ingot, a practice which is virtually impossible through the use of prior art devices. The system is thus peculiarly adapted to the fusion of ore and/or mineral bearing natural substances such as magnesium oxide, silicon carbide, and the like.

While not restricted hereto, the process has thus been proved equally effective in the heat conversion of quartz to cristobolite. The structure 110 thus lends itself to facile refractory lining either with a castable or with brick and the sloping cones 122–122' are equally adaptable to endwise lining, an impracticality in the known art.

Whereas the device has been described principally with respect to high speed, fusion activity, if lined with a refractory, it may be continuously fed and discharged while slow rotation is undertaken, as in roasting.

We claim:

1. Rotary furnace for the continuous electric heating and/or fusion of mineral bearing substances comprising:

(A) a cylindrical housing, said housing having a first conical extension fixed to one end thereof and a second removeable conical extension detachably secured to an opposite end thereof, both said extensions having outer openings which are coaxially aligned with the housing;

(B) opposed electrodes having a source of power, said electrodes being set in coaxial relation to the housing body and being removeably sustained, in spaced relation to each other and to the outer openings of the conical extensions; and (C) means engageable with the exterior of the housing to rotate the furnace.

2. The furnace of claim 1, wherein the removeable conical extension is secured to the housing by means of opposed clamp elements, said clamp elements having removeable locking means engaging the said clamp elements.

3. The furnace of claim 1, wherein a crane support is mounted upon each said housing and removeable conical extension for lifting and tilting the furnace to remove the contents thereof.

4. The furnace of claim 2, wherein a crane support is mounted upon each said housing and removeable conical extension for lifting and tilting the furnace to remove the contents thereof.

5. The furnace of claim 1, wherein the conical extensions are refractory lined.

* * * * *

US004217462B1

REEXAMINATION CERTIFICATE (2098th)

United States Patent [19]

[11] B1 4,217,462

Rawles et al.

[45] Certificate Issued Oct. 12, 1993

[54] ROTARY FURNACE FOR THE FUSION OF MINERAL BEARING SUBSTANCES, APPARATUS AND METHOD

[75] Inventors: William T. Rawles, Greeneville; Kenneth Jenkins, Moshein, both of Tenn.

[73] Assignee: Insul-Therm Co., Midway, Tenn.

Reexamination Requests:
No. 90/001,934, Feb. 7, 1990
No. 90/002,024, May 14, 1990
No. 90/002,353, May 24, 1991

Reexamination Certificate for:

| | |
|---|---|
| Patent No.: | **4,217,462** |
| Issued: | **Aug. 12, 1980** |
| Appl. No.: | **27,155** |
| Filed: | **Apr. 4, 1979** |

Related U.S. Application Data

[63] Continuation-in-part of Ser. No. 904,441, May 9, 1978, abandoned.

[51] Int. Cl.[5] ..... F27B 7/10; F27B 7/32; F27B 7/34

[52] U.S. Cl. ..... 373/62; 373/84; 266/213

[58] Field of Search ..... 373/62, 63, 64, 61, 373/84; 266/213, 204; 432/103; 414/149, 155, 209, 216

[56] References Cited

U.S. PATENT DOCUMENTS

| | | |
|---|---|---|
| Re. 16,054 | 4/1925 | Moore . |
| **296,227** | **4/1884** | Schulze-Berge . |
| 583,618 | 6/1897 | Eldridge et al. . |
| 682,365 | 9/1901 | Mount . |
| 698,766 | 4/1902 | Voelker . |
| 704,993 | 7/1902 | Weber . |
| 708,309 | 9/1902 | Brown . |
| 761,111 | 5/1904 | Thomson . |
| 801,378 | 10/1905 | Hart . |
| 908,151 | 12/1908 | Schwenzfeier . |
| 931,945 | 8/1909 | Mehner . |

(List continued on next page.)

FOREIGN PATENT DOCUMENTS

| | | |
|---|---|---|
| 153503 | 7/1904 | Fed. Rep. of Germany . |
| 310831 | 1/1916 | Fed. Rep. of Germany . |
| 315539 | 10/1919 | Fed. Rep. of Germany . |
| 543957 | 2/1932 | Fed. Rep. of Germany . |
| 639258 | 1/1935 | Fed. Rep. of Germany . |
| 632669 | 7/1936 | Fed. Rep. of Germany . |
| 639258 | 11/1936 | Fed. Rep. of Germany . |
| 656961 | 2/1938 | Fed. Rep. of Germany . |
| 678561 | 7/1939 | Fed. Rep. of Germany . |
| 681809 | 9/1939 | Fed. Rep. of Germany . |
| 2165172 | 7/1972 | Fed. Rep. of Germany . |

(List continued on next page.)

OTHER PUBLICATIONS

Transactions of the Electrochemical Society, "Production of Fused Silica", Rogers, et al., pp. 115–126, vol. 92, 1948.

Gilchrist, *Fuels, Furnaces and Refractories*, (Feb. 1977) pp. 139–149, 205 and 212–213.

Fused Quartz Manufacture in Germany, B.I.O.S. Final Report No. 1202, Item Nos. 9 & 21 (1946) p. 6, Section V.

(List continued on next page.)

*Primary Examiner*—Philip H. Leung

[57] ABSTRACT

Furnace apparatus and method, for the continuous electric heating or fusion of particulate mineral-bearing substances, wherein a cylindrical furnace housing is adapted to trunnion bearing, the housing having at least one detachable and elongated conical extension at ends for dumping, the extensions likewise having electrode openings which are coaxially aligned with the housing, whereby a charge of the mineral-bearing substance may be introduced either during fusion or heating or roasting or firing, thus permitting partial filling of the furnace housing and sequential build-up, protecting the respective ends of the furnace against dead space and excessive charge recycle. By virtue of design, the conical ends are shielded against burning out by unbearable heat generated from the electrode arc. Inherent advantages occur by highly accelerated rotation, yielding resultant centrifugal forces which are applied to the charge.

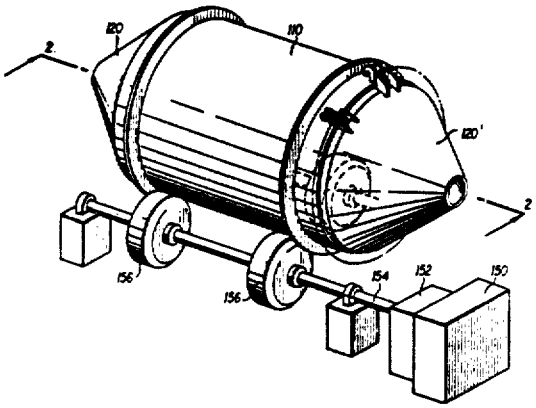

U.S. PATENT DOCUMENTS

| | | | |
|---|---|---|---|
| 961,268 | 6/1910 | Thomson . | |
| 961,269 | 6/1910 | Thomson . | |
| 993,105 | 5/1911 | Reid . | |
| 1,006,876 | 10/1911 | Queneau . | |
| 1,063,483 | 7/1913 | Weintraub . | |
| 1,064,992 | 6/1913 | Queneau . | |
| 1,068,716 | 7/1913 | Voelker . | |
| 1,082,195 | 12/1913 | Helfenstein . | |
| 1,103,060 | 7/1914 | Landis . | |
| 1,110,303 | 9/1914 | Kreusler . | |
| 1,132,684 | 3/1915 | Queneau . | |
| 1,155,358 | 10/1915 | Mulbert . | |
| 1,173,688 | 2/1916 | Thomson . | |
| 1,215,433 | 2/1917 | Trautmann . | |
| 1,229,324 | 6/1917 | Hosenblum . | |
| 1,232,785 | 7/1917 | Frost . | |
| 1,313,890 | 8/1919 | Gray | 373/84 |
| 1,339,393 | 5/1920 | Hughes . | |
| 1,368,990 | 2/1921 | Scharl . | |
| 1,371,084 | 3/1921 | Ferguson . | |
| 1,438,936 | 12/1922 | Elmer . | |
| 1,537,036 | 5/1925 | Miller . | |
| 1,541,584 | 6/1925 | Miller . | |
| 1,549,597 | 8/1925 | Miller . | |
| 1,559,203 | 9/1925 | Thomson . | |
| 1,577,602 | 3/1926 | Amsler . | |
| 1,581,829 | 4/1926 | Berry . | |
| 1,601,523 | 9/1626 | George . | |
| 1,739,344 | 12/1929 | Baily . | |
| 1,796,871 | 3/1931 | Madorsky . | |
| 1,831,619 | 10/1931 | Allen . | |
| 1,862,358 | 6/1932 | Devers . | |
| 1,863,708 | 6/1932 | Zotos . | |
| 1,870,636 | 8/1932 | McIntyre et al. . | |
| 1,876,733 | 9/1932 | Neuhauss . | |
| 1,877,714 | 9/1932 | Bulask . | |
| 1,880,540 | 10/1932 | Wadman . | |
| 1,889,509 | 11/1932 | Amsler . | |
| 1,897,973 | 2/1933 | Wadman . | |
| 1,899,516 | 2/1933 | Mabey . | |
| 1,927,736 | 1/1920 | Reid . | |
| 1,928,598 | 9/1933 | Morton et al. . | |
| 1,936,476 | 11/1933 | George . | |
| 1,951,753 | 3/1934 | George et al. . | |
| 1,953,023 | 3/1934 | Mulholland . | |
| 1,999,761 | 4/1935 | Howard . | |
| 1,999,762 | 4/1935 | Howard . | |
| 2,006,947 | 7/1935 | Ferguson . | |
| 2,007,755 | 7/1935 | Ferguson . | |

(List continued on next page.)

FOREIGN PATENT DOCUMENTS

| | | | |
|---|---|---|---|
| 657375 | 5/1929 | France . | |
| 675375 | 5/1929 | France . | |
| 743966 | 3/1934 | France . | |
| 410281 | 7/1935 | France . | |
| 810750 | 3/1937 | France . | |
| 817479 | 9/1937 | France . | |
| 825529 | 3/1938 | France . | |
| 829651 | 7/1938 | France | 373/84 |
| 832510 | 9/1938 | France . | |
| 834321 | 11/1938 | France . | |
| 851630 | 1/1940 | France . | |
| 894133 | 3/1944 | France . | |
| 1405958 | 6/1965 | France . | |
| 1488206 | 7/1967 | France . | |
| 72258 | 3/1951 | Netherlands . | |
| 75892 | 11/1949 | Norway . | |
| 79155 | 10/1951 | Norway . | |
| 180006 | 12/1935 | Switzerland . | |
| 180519 | 1/1936 | Switzerland . | |
| 18437 | of 1905 | United Kingdom . | |
| 9522 | of 1906 | United Kingdom . | |
| 14774 | of 1907 | United Kingdom . | |
| 10930 | of 1910 | United Kingdom . | |
| 242214 | 12/1925 | United Kingdom . | |
| 270692 | 8/1927 | United Kingdom . | |
| 04557 | 1/1928 | United Kingdom . | |
| 330943 | 6/1930 | United Kingdom . | |
| 374761 | 6/1932 | United Kingdom . | |
| 375500 | 6/1932 | United Kingdom . | |
| 400020 | 10/1933 | United Kingdom . | |
| 411162 | 6/1934 | United Kingdom . | |
| 431004 | 6/1935 | United Kingdom . | |
| 431021 | 6/1935 | United Kingdom . | |
| 445592 | 4/1936 | United Kingdom . | |
| 450927 | 7/1936 | United Kingdom . | |

(List continued on next page.)

OTHER PUBLICATIONS

Encyclopedia of Chemical Technology, Kirk-Othmer, John-Wiley and Sons, Inc. (1969).

Fused Quartz Manufacture in Germany, Fiat Final Report No. 536 (1945) p. 26.

McMaster-Carr Supply Co., Catalog 64, 1958, p. 1297.

Sears Owners Manual, Model 106.161050, Paint Tank, Apr. 1977.

Henri George, "Les fours electriques a rayonnement" *Revue Generale De L'Electricite,* Apr. 1947 (attached (List continued on next page.)

U.S. PATENT DOCUMENTS

| | | | |
|---|---|---|---|
| 2,008,495 | 7/1935 | Ferguson . | |
| 2,018,477 | 10/1935 | Wentz . | |
| 2,018,884 | 10/1935 | Ferguson . | |
| 2,022,112 | 11/1935 | Ferguson . | |
| 2,027,155 | 1/1936 | Devers . | |
| 2,037,228 | 4/1936 | George . | |
| 2,046,419 | 7/1936 | Tourville . | |
| 2,074,819 | 3/1937 | Weitzenkorn . | |
| 2,089,022 | 8/1937 | George et al. . | |
| 2,104,555 | 1/1938 | Cousteix . | |
| 2,104,557 | 1/1938 | George et al. . | |
| 2,121,109 | 6/1938 | Weinheimer | 373/72 |
| 2,125,912 | 8/1938 | George et al. . | |
| 2,126,454 | 8/1938 | Crocker . | |
| 2,154,737 | 4/1939 | Erdmann . | |
| 2,161,850 | 6/1939 | Christensen . | |
| 2,188,121 | 1/1940 | Smith . | |
| 2,200,372 | 5/1940 | Linder . | |
| 2,214,123 | 9/1940 | Delpech . | |
| 2,261,676 | 11/1941 | Eisenschmid . | |
| 2,262,070 | 11/1941 | Turk . | |
| 2,268,115 | 12/1941 | George . | |
| 2,272,342 | 2/1942 | Hyde . | |
| 2,292,826 | 8/1942 | Devers . | |
| 2,325,521 | 7/1943 | Lambert . | |
| 2,398,952 | 4/1946 | Nachol . | |
| 2,413,231 | 12/1946 | Hoke . | |
| 2,445,063 | 7/1948 | Geyer . | |
| 2,451,582 | 10/1948 | Smith . | |
| 2,455,907 | 12/1948 | Slayter . | |
| 2,526,241 | 10/1950 | Burthe et al. . | |
| 2,527,144 | 10/1950 | Meacham et al. . | |
| 2,545,728 | 3/1951 | Everett . | |
| 2,552,395 | 5/1951 | Borel . | |
| 2,585,607 | 2/1952 | Whitmore et al. . | |
| 2,592,010 | 4/1952 | Cole et al. . | |
| 2,600,490 | 6/1952 | De Voe . | |
| 2,680,772 | 6/1954 | Skinner et al. . | |
| 2,688,046 | 8/1954 | Norton, Jr. et al. | 373/62 |
| 2,689,433 | 9/1954 | Mathews . | |
| 2,693,498 | 11/1954 | Penberthy . | |
| 2,793,018 | 5/1957 | Trombe . | |
| 2,852,891 | 9/1958 | George . | |
| 2,863,638 | 5/1958 | Steinhoff et al. . | |
| 2,866,697 | 12/1958 | Elliot . | |
| 2,897,126 | 7/1959 | George . | |
| 2,913,509 | 11/1959 | Pinotti . | |
| 2,916,536 | 12/1959 | Grumer et al. . | |
| 2,921,106 | 1/1960 | Arbeit . | |
| 2,931,708 | 4/1960 | Aamot . | |
| 2,936,505 | 5/1960 | Witucki et al. . | |

(List continued on next page.)

FOREIGN PATENT DOCUMENTS

| | | |
|---|---|---|
| 454071 | 9/1936 | United Kingdom . |
| 481229 | 3/1938 | United Kingdom . |
| 484728 | 5/1938 | United Kingdom . |
| 489207 | 7/1938 | United Kingdom . |
| 498379 | 1/1939 | United Kingdom . |
| 500803 | 2/1939 | United Kingdom . |
| 500847 | 2/1939 | United Kingdom . |
| 506696 | 6/1939 | United Kingdom . |
| 507280 | 6/1939 | United Kingdom . |
| 520942 | 5/1940 | United Kingdom . |
| 530949 | 12/1940 | United Kingdom . |
| 531676 | 1/1941 | United Kingdom . |
| 531881 | 1/1941 | United Kingdom . |
| 543159 | 2/1942 | United Kingdom . |
| 575098 | 2/1946 | United Kingdom . |
| 597838 | 2/1948 | United Kingdom . |
| 601735 | 5/1948 | United Kingdom . |
| 611217 | 10/1948 | United Kingdom . |
| 1036893 | 6/1966 | United Kingdom . |

OTHER PUBLICATIONS translation) pp. 147–155.

J. W. Cuthburston, "Electrothermal Processes," *Journal of the Institution of Electrical Engineers,* vol. 80 No. 482, Feb. 1937 pp. 211–217.

H. George, "Electric Furnaces With Carbon Radiator," *Transactions of the American Institute of Electrical Engineers,* vol. 54. pp. 1195–1199 (1935).

H. George, "Graphite Resistor Radiator Furnaces and Their Applications to High Temperatures" *Transactions of the Electrochemical Society,* vol. LXVIII, pp. 53–63 (1936).

Fused Quartz Manufacture In Germany, Malvern J. Gross, Field Information Agency Technical, Nov. 29, 1945.

Industrial Electric Furnaces and Appliances, vol. II, V. Paschkis, 1948 pp. 151–153.

Elektroofen In Der Glasindustrie, Von R. Rumler, pp. 47–49.

Elektrowarme, Die Bedeutung des Elektroofens in der Glasindustrie, Von Chef-Ing. Suttor, Dec. 1938, pp. 301–308.

Elektrowarme, Elecktrisches Glasschmelzen, Von Y. R. Cornelius, Nov. 1938, pp. 277–282.

Weshalb So Viele Arten Elektrischer Widerstandsofen?, Von Gerhard Simon, pp. 11–20.

The Centrifugal Liquid Wall Furnace, B. Selton & J. A. Sheward, Journal of Materials Science, 1969, pp.

(List continued on next page.)

U.S. PATENT DOCUMENTS

| | | | |
|---|---|---|---|
| 2,971,966 | 2/1961 | Steig . | |
| 2,984,868 | 5/1961 | Hill . | |
| 2,997,006 | 8/1961 | Grosse | 110/341 |
| 3,030,094 | 4/1962 | Saeman . | |
| 3,102,154 | 8/1963 | Renton | 373/62 |
| 3,109,045 | 10/1963 | Silverman . | |
| 3,147,328 | 9/1964 | Le Clerc de Bussy . | |
| 3,151,964 | 10/1964 | North . | |
| 3,219,868 | 11/1965 | Mason et al. . | |
| 3,230,291 | 1/1966 | Walz . | |
| 3,257,196 | 6/1966 | Foex . | |
| 3,275,048 | 9/1966 | Statler et al. . | |
| 3,275,408 | 9/1966 | Winterburn . | |
| 3,394,242 | 7/1968 | King . | |
| 3,404,973 | 10/1968 | Nedelec . | |
| 3,419,667 | 12/1968 | Walz . | |
| 3,442,622 | 5/1969 | Monnier et al. . | |
| 3,479,138 | 11/1969 | Saeman . | |
| 3,528,792 | 9/1970 | Wilson . | |
| 3,531,275 | 9/1970 | Magnusson . | |
| 3,531,677 | 9/1970 | Loughridge . | |
| 3,652,245 | 3/1972 | Jung . | |
| 3,674,904 | 7/1972 | Jung . | |
| 3,689,242 | 9/1972 | Platakis et al. . | |
| 3,689,679 | 9/1972 | Niwa et al. . | |
| 3,700,428 | 10/1972 | Donnier et al. . | |
| 3,749,802 | 7/1973 | Camacho . | |
| 3,749,803 | 7/1973 | Camacho . | |
| 3,754,886 | 8/1973 | Richards et al. . | |
| 3,795,752 | 3/1974 | Verhoeven et al. | 373/20 |
| 3,802,847 | 4/1974 | Hara et al. . | |
| 3,812,275 | 5/1974 | Schempp et al. | 373/84 |
| 3,821,455 | 6/1974 | Greenewald, Jr. | 373/62 |
| 3,830,950 | 8/1974 | Schoumaker et al. . | |
| 3,837,825 | 9/1974 | Loxley et al. . | |
| 3,852,053 | 12/1974 | Eirambof et al. . | |
| 3,853,520 | 12/1974 | Ram . | |
| 3,895,174 | 7/1975 | Jung . | |
| 3,895,175 | 7/1975 | Krogarud . | |
| 3,937,866 | 2/1976 | Sunnen et al. | 373/20 |
| 3,957,474 | 5/1976 | Kobayashi et al. . | |
| 3,982,916 | 9/1976 | Miller . | |
| 3,992,994 | 3/1935 | Delfech . | |
| 4,040,795 | 8/1977 | Jung . | |
| 4,102,663 | 7/1978 | Jung . | |
| 4,178,165 | 12/1979 | Jung . | |
| 4,180,381 | 12/1979 | Caisander . | |
| 4,188,201 | 2/1980 | Jung . | |
| 4,386,846 | 6/1983 | Clark et al. . | |
| 4,559,312 | 12/1985 | Kim et al. . | |

OTHER PUBLICATIONS 302-309.

A Rotating-Wall, D.C.-Arc Plasma Furnace, D. Whyman, J. Sci. Instrum., 1967, vol. 44, pp. 525-530.

Der Glasschmelz-Drehofen Nach Zotos., Von Dipl.--Ing. et al., Glastechn. Ber., Dec. 1934, pp. 423-426.

Elektrisch Beheizte Glasschmelzofen, Von Der.Ing. et al., H. Nathusius: Electrisch beheizte Glasschmelzofen, Nov. 1934, pp. 385-387.

Sprechsaal-Coburg, May 25, 1933.

Referate, Glastechn. Ber. Jul. 1933, pp. 253-254.

The Centrifugal Plasma Jet Furnace, A. V. Grosse et al., Materials Research & Standards, Apr. 1965, pp. 173-177.

Rotary Plasma Furnace, D. Yerouchalmi, Electrotherm.

High Temperature Rotary Furnace For Melting Refractory Materials Heated Along Central Axis By Plasma Torches M. Foex et al., pp. 387-391.

The Centrifugal Liquid Wall Furnace, B. Selton et al., Journal of Materials Science, 1969, pp. 302-309.

A Plasma Transferred-Arc Heated High-Temperature Rotary Furnace, Foex et al., pp. 175-183.

Four Electrique De Laboratoire Pour Les Temperatures Tres Elevees, George, Nov. 1935, pp. 339-343.

Fours Electriques A Rayonnement A Resistances De Carbone et Leur Application A Las Fusion Des Metaux, Section Industrielle, Jun. 1934, pp. 851-856.

Fours Electriques A Rayonnement A Resistance De Carbone Leur Application A La Fusion Des Metaux, George, Dec. 1934, pp. 337-346.

Fours Electriques A Rayonnement A Resistance De Carbone Leur Application A La Fusion Des Metaux, George Dec. 1934, pp. 337-341.

Electrochimie-Electrometallurgie Piles-Accumulateurs, pp. 142-143.

Le Verre De Silice, George, Bulletin De La Societe D'Encourage Pour L'Industrie National, May 1928, pp. 373-408.

Notes Sur Les Refractaries Pour Temperatures Tres Elevees.

Nouveaux Fours Electriques A Resistances A Tres Haute Temperature, Journal aDu Four Electrique et des Industries Electrochimiques pp. 247-252.

Quelques Emplois Du Four Electrique A Resistances Dans L'Industrie, Journal du Four Electrique et des Industries Electrochimiques, pp. 327-329.

Four Electrique De Laboratoire Pour Les Temperatures Tres Elevees, Journal de Four Electrique et des Industries Electrochimiques, pp. 285-289.

Quelques Emplois Du Four Electriques A Resistances Dan l'Industrie, Journal de Four Electrique et des Industries Electrochimiques, pp. 282-290.

New Electric Furnaces With High Temperature Resistances, (translation).

Nouveaux Fours Electriques A Resistances A Tres Haute Temperature, Journal de Four Electrique et des Industries Electrochimiques, pp. 247-252.

Fours Electriques A Radiateur De Graphite, George, 1937-8, Part 5, vol. VII, No. 80, pp. 785-796 (translation).

Fours Electriques A Radiateur De Graphite, George, Aug. 1937, pp. 785-796.

Section 3 Electrochemistry-Electrometallurgy. Batteries.-Condensers, Series 5, vol. VIII, No. 86, 1938-1.

Radiant Heat Electric Ovens (translation), George.

Les Fours Electriques A Rayonnement, Section Industrielle, Apr. 1947, pp. 147-155.

Silica Glass, George, May 1928 (translation).

Le Verre De Silice, Bulletin de la Societe d'Encourag, Pour L'Industrie Nationale, May 1928, George pp. 373-407.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, and 5 are cancelled.

Claims 3 and 4 are determined to be patentable as amended.

New claims 6–22 are added and determined to be patentable.

3. [The] *Rotary* furnace [of claim 1, wherein] *for the continuous electric heating and/or fusion of mineral bearing substances comprising:*

(*A*) *a cylindrical housing, said housing having a first conical extension fixed to one end thereof and a second removeable conical extension detachably secured to an opposite end thereof, both said extensions having outer openings which are coaxially aligned with the housing;*

(*B*) *opposed electrodes having a source of power, said electrodes being set in coaxial relation to the housing and being removeably sustained, in spaced relation to each other and to the outer openings of the conical extensions;*

(*C*) *means engageable with the exterior of the housing to rotate the housing; and*

(*D*) a crane support [is] mounted upon each said housing and removeable conical extension for lifting and tilting the [furnace] *housing* to remove the contents thereof.

4. [The furnace of claim 2, wherein] *Rotary furnace for the continuous electric heating and/or fusion of mineral bearing substances comprising:*

(*A*) *a cylindrical housing, said housing having a first conical extension fixed to one end thereof and a second removeable conical extension detachably secured to an opposite end thereof, both said extensions having outer openings which are coaxially aligned with the housing, the removeable conical extension being secured to the housing by means of opposed clamp elements, said clamp elements having removeable locking means engaging the said clamp elements;*

(*B*) *opposed electrodes having a source of power, said electrodes being set in coaxial relation to the housing and being removeably sustained, in spaced relation to each other and to the outer openings of the conical extensions; and*

(*C*) *means engageable with the exterior of the housing to rotate the housing; and*

(*D*) a crane support [is] mounted upon each said housing and removeable conical extension for lifting and tilting the [furnace] *housing* to remove the contents thereof.

*6. A furnace as in claim 3, wherein the housing is adapted to be charged with a mineral bearing substance which is continuously heated and fused while the housing rotates so as to form an ingot within the housing.*

*7. A furnace as in claim 3, wherein said first conical extension is non-removable.*

*8. A furnace as in claim 3, wherein the housing has a longitudinal axis and walls of said conical extensions are inclined at an angle relative to said longitudinal axis so that, upon rotation of the housing, a portion of a mineral bearing charge is urged into the conical extensions and along the walls thereof to thereby insulate and retard heat deterioration of the conical extensions.*

*9. A furnace as in claim 8, wherein said means for rotating rotate said housing at about 120–130 rpm.*

*10. A furnace as in claim 3, wherein the housing has a longitudinal axis and said means for rotating comprise means for rotating said housing about said longitudinal axis at a speed sufficient to impart centrifugal forces to mineral bearing substances disposed within said housing.*

*11. A furnace as in claim 10, wherein walls of said conical extensions are inclined at an angle relative to said longitudinal axis of the housing so that rotation of said housing at said speed sufficient to impart centrifugal forces urges material outwardly toward the apex of each conical extension, whereby said walls of said conical extensions are insulated from heat within the housing in the absence of a refractory lining.*

*12. A furnace as in claim 3, wherein each said crane support comprises an element which is selectively engageable with a lifting device, so that, when said detachable conical extension is detached from said housing, the housing can be lifted and tilted to remove a fused ingot from the housing.*

*13. A furnace as in claim 3, wherein said means for rotating comprise first and second rotating shafts and at least one wheel element mounted to each of said rotating shafts for engaging and supporting an exterior surface of the housing and rotating the housing.*

*14. Rotary furnace for the continuous electric heating and fusion of mineral bearing substances comprising:*

*a cylindrical housing having a longitudinal axis, said housing having a first conical extension fixed to one end thereof and a second removable conical extension detachably secured to an opposite end thereof to provide for selective access to and removal of a fused mass formed in the interior of the housing, both said extensions having outer openings which are coaxially aligned with the housing;*

*opposed electrodes having a source of power, said electrodes being set in coaxial relation to the housing and being removably sustained, in spaced relation to each other and to the outer openings of the conical extensions; and*

*means engageable with the exterior of the housing to rotate the housing.*

*15. A furnace as in claim 14, wherein walls of said conical extensions are inclined at an angle relative to said longitudinal axis of said housing so that, upon rotation of the housing, a portion of a mineral bearing charge is urged into the conical extensions and along the walls thereof to thereby insulate and retard heat deterioration of the conical extensions.*

*16. A furnace as in claim 14, wherein said means for rotating comprise means for rotating said housing at a speed sufficient to impart centrifugal forces to material disposed within said housing.*

*17. A furnace as in claim 16, wherein said housing has a longitudinal axis and walls of said conical extensions are*

*inclined at an angle relative to said longitudinal axis so that rotation of said housing at said speed sufficient to impart centrifugal forces urges mineral bearing material outwardly toward the apex of each conical extension, whereby said walls of said conical extensions are insulated from heat within the housing in the absence of a refractory lining.*

*18. A furnace as in claim 14, further comprising crane supports attached to the housing and to the removable conical extension, each crane support comprising an element which is selectively engageable with a lifting device, so that, when said detachable conical extension is detached from said housing, the housing can be lifted and tilted to remove a fused mass from the interior of the housing.*

*19. Rotary furnace for the continuous electric heating and fusion of mineral bearing substances comprising:*

*a cylindrical housing having a longitudinal axis, said housing having a first conical extension fixed to one end thereof and a second removable conical extension detachably secured to an opposite end thereof so that said second conical extension is selectively disengageable from said housing whereby a fused ingot can be selectively removed from within the housing by tilting the housing, both said extensions having outer openings which are coaxially aligned with the housing;*

*opposed first and second electrode elements, each being removably inserted through a respective said opening into said housing, said electrode elements being radially spaced from peripheral edges of said openings and disposed co-axially along said longitudinal axis of said housing in longitudinally spaced, facing relation;*

*a source of power for said electrode elements; and*

*means engageable with the exterior of the housing to rotate the housing, whereby upon rotation of said housing, centrifugal forces drive mineral bearing substances disposed within the housing into said conical extensions and along the walls thereof so as to insulate the walls of the conical extensions.*

*20. Rotary furnace for the continuous electric heating and fusion of mineral bearing substances comprising:*

*a cylindrical housing, said housing having a first conical extension fixed to one end thereof and a second removable conical extension detachably secured to an opposite end thereof, both said extensions having outer openings which are coaxially aligned with the housing, said cylindrical housing and said first and second conical extensions being substantially free of refractory lining;*

*opposed electrodes having a source of power, said electrodes being set in coaxial relation to the housing and being removably sustained, in spaced relation to each other and to the outer openings of the conical extensions; and*

*means engageable with the exterior of the housing to rotate the housing.*

*21. A furnace as in claim 20, wherein walls of said conical extensions are inclined at an angle relative to a longitudinal axis of said housing such that, upon rotation of the housing, a portion of a mineral bearing charge therewithin is urged into the conical extensions and along the walls thereof to thereby insulate and retard deterioration of the conical extensions.*

*22. A furnace as in claim 20, wherein said first conical extension is non-removable.*

* * * * *

US004217462B1

REEXAMINATION CERTIFICATE (2831th)

United States Patent [19] [11] B2 4,217,462

Rawles et al. [45] Certificate Issued Apr. 9, 1996

[54] ROTARY FURNACE FOR THE FUSION OF MINERAL BEARING SUBSTANCES, APPARATUS AND METHOD

[75] Inventors: William T. Rawles, Greeneville; Kenneth Jenkins, Moshein, both of Tenn.

[73] Assignee: ITC Acquisition Company, Midway, Tenn.

Reexamination Request:
No. 90/003,913, Jul. 25, 1995

Reexamination Certificate for:

| | |
|---|---|
| Patent No.: | **4,217,462** |
| Issued: | **Aug. 12, 1980** |
| Appl. No.: | **27,155** |
| Filed: | **Apr. 4, 1979** |

Reexamination Certificate B1 4,217,462 issued Oct. 12, 1993

Related U.S. Application Data

[63] Continuation-in-part of Ser. No. 904,441, May 9, 1978, abandoned.

[51] Int. Cl.[6] ..... F27B 7/10; F27B 7/32; F27B 7/34

[52] U.S. Cl. ..... 373/62; 373/84; 266/213

[58] Field of Search ..... 373/62, 63, 64, 373/61, 84; 266/213, 204; 432/103; 414/149, 155, 209, 216

[56] References Cited

U.S. PATENT DOCUMENTS

| | | |
|---|---|---|
| Re. 16,054 | 4/1925 | Moore . |
| 583,618 | 6/1897 | Eldridge et al. . |
| 1,313,890 | 8/1919 | Gray . |
| 2,104,555 | 1/1938 | Cousteix . |
| 2,200,372 | 5/1940 | Linder . |

OTHER PUBLICATIONS

McMaster–Carr Supply Co., Catalog 64, 1958, p. 1297.

*Primary Examiner*—Philip H. Leung

[57] ABSTRACT

Furnace apparatus and method, for the continuous electric heating or fusion of particulate mineral-bearing substances, wherein a cylindrical furnace housing is adapted to trunnion bearing, the housing having at least one detachable and elongated conical extension at ends for dumping, the extensions likewise having electrode openings which are coaxially aligned with the housing, whereby a charge of the mineral-bearing substance may be introduced either during fusion or heating or roasting or firing, thus permitting partial filling of the furnace housing and sequential build-up, protecting the respective ends of the furnace against dead space and excessive charge recycle. By virtue of design, the conical ends are shielded against burning out by unbearable heat generated from the electrode arc. Inherent advantages occur by highly accelerated rotation, yielding resultant centrifugal forces which are applied to the charge.

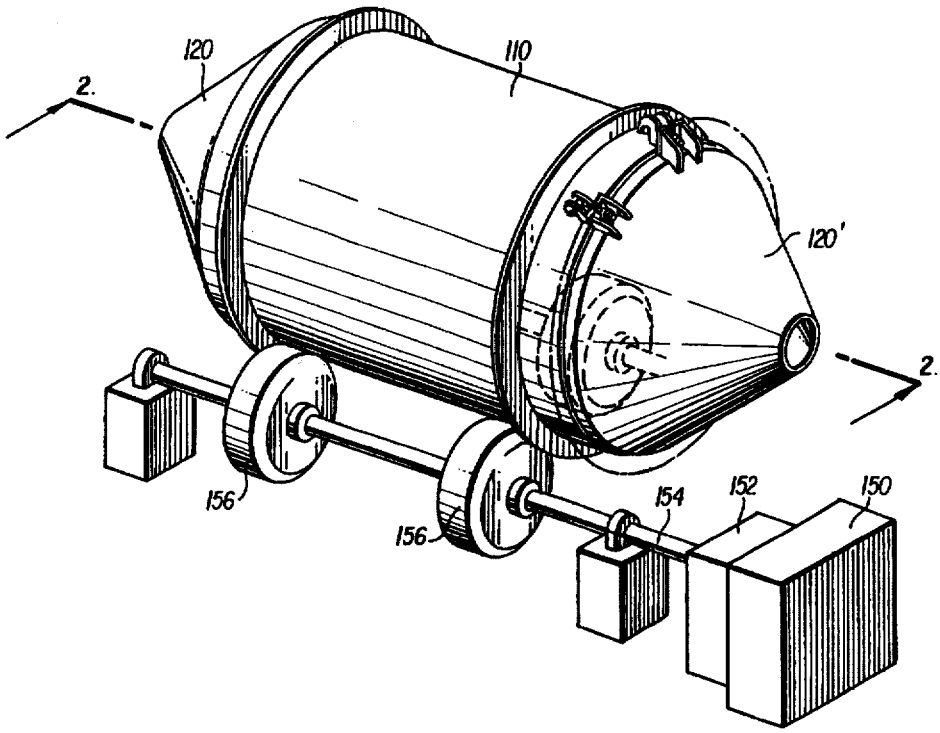

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 3, 4 and 6–22 is confirmed.

Claims 1, 2 and 5 were previously cancelled.

* * * * *